US006568901B2

(12) United States Patent
Wang et al.

(10) Patent No.: US 6,568,901 B2
(45) Date of Patent: May 27, 2003

(54) BALANCER FOR MULTISTAGE CENTRIFUGAL PUMPS

(75) Inventors: Bao Wang, Frankenthal (DE); Bernhard Brecht, Frankenthal (DE); Juergen Schill, Weisenheim an Berg (DE)

(73) Assignee: KSB Aktiengesellschaft, Frankenthal (DE)

( * ) Notice: Subject to any disclaimer, the term of this patent is extended or adjusted under 35 U.S.C. 154(b) by 0 days.

(21) Appl. No.: 10/014,836

(22) Filed: Dec. 14, 2001

(65) Prior Publication Data

US 2002/0114713 A1 Aug. 22, 2002

Related U.S. Application Data

(63) Continuation of application No. PCT/EP00/04754, filed on May 25, 2000.

(30) Foreign Application Priority Data

Jun. 15, 1999 (DE) ..... 199 27 135

(51) Int. Cl.[7] ..... F04D 29/00
(52) U.S. Cl. ..... 415/104
(58) Field of Search ..... 415/104, 105, 415/106, 107, 229; 417/365

(56) References Cited

U.S. PATENT DOCUMENTS

| | | | | | |
|---|---|---|---|---|---|
| 2,605,147 | A | * | 7/1952 | Raichle et al. | 415/104 |
| 3,393,947 | A | | 7/1968 | Sandy, Jr. et al. | |
| 3,468,259 | A | * | 9/1969 | Morzynski et al. | 415/175 |
| RE28,540 | E | * | 9/1975 | Ball | 415/111 |
| 4,468,176 | A | * | 8/1984 | Munch | 415/104 |
| 5,713,720 | A | * | 2/1998 | Barhoum | 384/123 |
| 5,980,114 | A | * | 11/1999 | Oklejas, Jr. | 384/123 |

FOREIGN PATENT DOCUMENTS

| | | |
|---|---|---|
| DE | 886250 | 8/1953 |
| DE | 19640734 | 4/1998 |
| JP | 09014181 | 1/1997 |
| RU | 2083860 | 7/1997 |

OTHER PUBLICATIONS

Holzenberger, et al. "Introduction to the 3. Edition" The Editors, Sep. 1990.
Holzenberger, et al. "Introduction to the 3. Edition" The Editors, Jul. 1989.
"Kreiselpumpen Lexikon", Article No. XP002149200, Jul. 1989.
Several portions of Mechanical Dictionary, pp. 18–23 and pp. 216–229.
Copy of the International Search Report.
Copy of German Office Action dated Jan. 7, 2000.

* cited by examiner

*Primary Examiner*—Ninh Nguyen
(74) *Attorney, Agent, or Firm*—Crowell & Moring LLP

(57) ABSTRACT

A balancing arrangement which is used to relieve or take up axial thrust in a multistage centrifugal pump, having a balancing device with at least one axial gap (8) and at least one radial gap (6,7) and in which a balancing flow is conducted through the gaps, and having an axial bearing which receives remaining axial thrust. Associated with the axial bearing is a cardanic ring (10) which serves to offset alignment errors. Highly reliable operation with only low leakage losses is achieved by configuring the balancing device such that a residual thrust in the direction of the suction side of the pump exists in all operating conditons and the cardanic ring is designed such that it is elastically deformed by the residual thrust and has a spring constant such that the axial gap (s) will close from a maximum width position when the pump is at rest to a minimum width position during operation while still avoiding contact between the surfaces which define the axial gap.

7 Claims, 2 Drawing Sheets

BALANCER FOR MULTISTAGE CENTRIFUGAL PUMPS

CROSS REFERENCE TO RELATED APPLICATIONS

This application is a continuation of international patent application no. PCT/EP00/04754, filed May 25, 2000, the entire disclosure of which is incorporated herein by reference. Priority is claimed based on Federal Republic of Germany patent application no. DE 199 27 135.6, filed Jun. 15, 1999.

BACKGROUND OF THE INVENTION

The invention relates to a device for absorbing the axial thrust of a multistage centrifugal pump, with a balancing device which has one or more axial gaps and one or more radial gaps and in which a balancing stream is conducted through the gaps, and with an axial bearing absorbing the remaining residual thrust, the axial bearing having an associated cardanic ring which serves, among other things, to compensate errors of alignment.

In order to absorb the axial thrust in multistage centrifugal pumps, essentially three different types of balancing devices are known: balancing disk, balancing piston and stepped piston. The latter is constructed, in the form predominantly in use, as a double piston. These devices are described under the keyword "axial thrust" in the KSB Centrifugal Pump Lexicon, third edition, 1989.

What is common to all three versions is a balancing stream conducted via gaps. The balancing stream, which usually is conducted back to the inlet of the centrifugal pump, represents a leakage loss for the pump. Attempts have been made to minimize this leakage loss by using gap widths which are as small as possible. In such a case, however, care must be taken to assure that rubbing of the moving parts of the centrifugal pump against stationary parts of the pump is avoided as far as possible under all operating conditions. Rubbing of the pump rotor in the casing may lead to frictional wear on surfaces located opposite one another and ultimately to failure of the centrifugal pump.

The gap losses occurring in each case due to the balancing stream differ in amount in each of the three types of balancing device. Thus, the radial gap surrounding the single balancing piston results particularly in a large gap stream and therefore in a sharp decrease in efficiency of the centrifugal pump. By contrast, the gap loss of a stepped-piston balancing device, which, depending on the number of steps, has at least two radial gaps and in each case an axial gap arranged between the radial gaps, is substantially lower. What is common to both versions operating with pistons is that they also require an axial bearing which absorbs a remaining residual thrust.

The balancing device which comprises a balancing disk does not, in principle, require such an axial bearing, since the balancing disk has a self-regulating effect. Since the substantially axial gap between the balancing disk and the nonrotating counterdisk is set very narrow, the leakage loss of this type of device also remains relatively low. However, when centrifugal pumps with high output pressures and large capacities are operated in a transient mode of operation, the balancing disk may rub against the counterdisk. Thus, the operating reliability of such pumps is no longer assured.

SUMMARY OF THE INVENTION

It is an object of the invention to provide an improved balancing device for a multistage centrifugal pump.

Another object of the invention is to provide a balancing device for a multistage centrifugal pump which incurrs only minimal leakage losses and yet exhibits a high operating reliability.

These and other objects are achieved in accordance with the present invention by providing a balancing arrangment for absorbing axial thrust of a multistage centrifugal pump with a suction side and a pressure side, comprising a balancing device having at least one axial gap and at least one radial gap delimited by opposed faces of the balancing device and in which a balancing stream is conducted through the gaps, an axial bearing for absorbing remaining residual thrust, a cardanic ring associated with the axial bearing and serving to compensate for alignment errors, wherein said balancing device is constructed such that a residual thrust in the direction of the suction side of the pump exists in all operating states of the pump, and the cardanic ring is dimensioned such that it is elastically deformed by the residual thrust and has a spring constant such that, starting from a maximum gap width (s) when the pump is at rest, the axial gap closes under operating conditions to a minimum width at which contact between the opposed faces delimiting the axial gap is still avoided.

The balancing device of the present invention is constructed in such a way that, in all the operating states, a residual thrust occurs which acts in the direction of the suction side of the centrifugal pump, and such that the cardanic ring is dimensioned so that it is deformed elastically by the residual thrust. The spring constant of the cardanic ring is selected such that, starting from a maximum gap width when the centrifugal pump is in a state of rest, the axial gap closes under operating conditions to a minimum width at which contact between the faces delimiting the axial gap is still avoided. If the balancing device comprises a stepped piston with a plurality of axial gaps, this described condition applies to all the axial gaps.

However, the invention is not only useful with balancing devices comprising double pistons or multistep pistons. It may also be employed in the case of balancing disks. Admittedly, an additional axial bearing with a cardanic ring entails an increased expense in the case of a device with a balancing disk. However, since the operating reliability in centrifugal pumps with high output pressures and large capacities can thereby be assured, even in the case of a transient mode of operation, the expense is justified at least in this case.

The invention can be used especially advantageously conjunction with a hydrodynamic axial bearing.

DETAILED DESCRIPTION OF A PREFERRED EMBODIMENT

Figure 1:
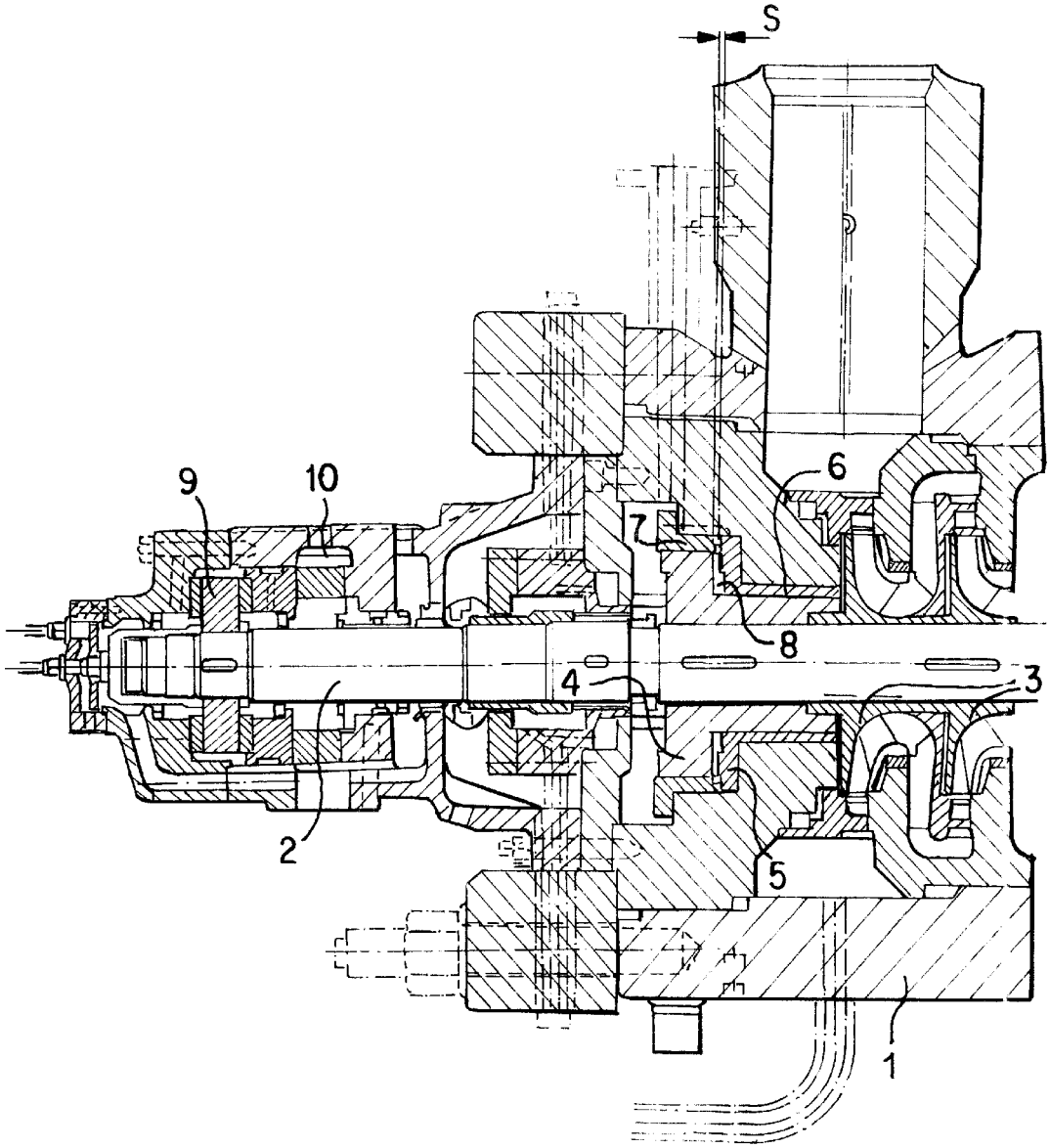
FIG. 1 shows a detail sectional view of a multistage centrifugal pump.

The drawing FIG. 1 shows a shaft 2 mounted in the casing 1 of a centrifugal pump. Shaft 2 carries a plurality of pump rotors 3, only two of which can be seen in the drawing.

Additionally, a double piston 4 of a balancing device according to the invention is fastened on the shaft 2. The double piston 4 is surrounded by a casing part 5 with which it forms two radial gaps 6 and 7. Between the radial gaps 6 and 7 there is an axial gap 8. The axial gap 8 has a variable width s.

At the pressure or outlet side of the centrifugal pump, the shaft 2 is received by a hydrodynamic axial bearing 9. Associated with the axial bearing 9 is a cardanic ring 10. In the first place, the cardanic ring 10 serves to compensate in a known way for errors of alignment which are unavoidable during the assembly of a multistage centrifugal pump. In addition, however, the cardanic ring 10 is dimensioned in such a way that it is deformed elastically by the residual thrust occurring in the centrifugal pump. The spring constant of the cardanic ring 10 is thereby adapted or matched to the other parameters of the balancing device.

The balancing device is designed in such a way that, in all the operating states of the centrifugal pump, a residual thrust occurs which acts in the direction of the suction side. Starting from a maximum width s of the axial gap 8 in the state of rest of the centrifugal pump, the gap 8 is closed due to an elastic deformation of the cardanic ring 10 under operating conditions to a predetermined minimum width at which contact between those faces of the double piston 4 and of the casing part 5 which delimit the gap 8 is still avoided. At the same time, a useful feature of the balancing device according to the invention is that the axial gap 8 has a self-regulating function, as is the case in a similar manner with a balancing disk.

Figure 2:
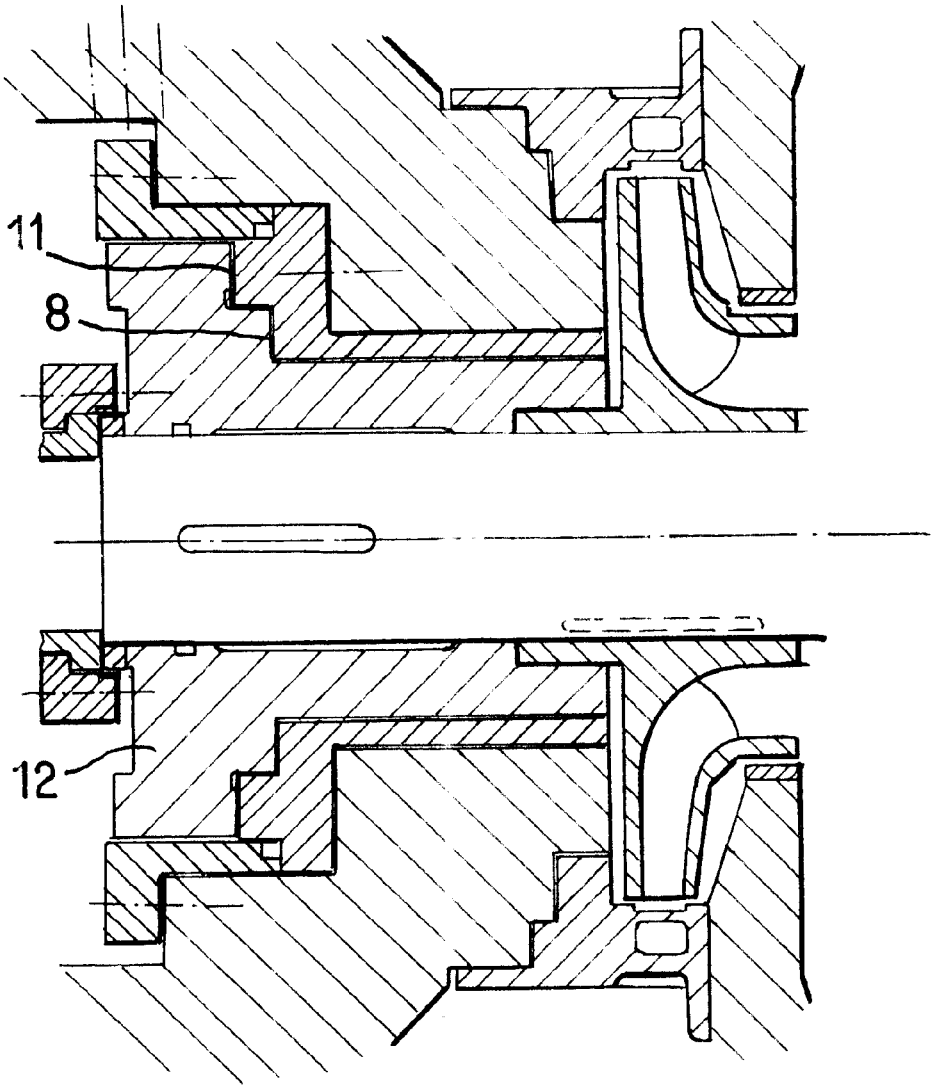
FIG. 2 shows a sectional view of a stepped piston.

In another embodiment shown in FIG. 2, the balancing device is formed by a stepped piston 12, and each axial gap 8, 11 is located between two steps of the stepped piston 12.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations falling within the scope of the appended claims and equivalents thereof.

What is claimed is:

1. A balancing arrangement for absorbing axial thrust of a multistage centrifugal pump with a suction side and a pressure side, comprising:

a balancing device having an axial gap and at least one radial gap delimited by opposed faces of the balancing device and in which a balancing stream is conducted through the gaps, an axial bearing for absorbing remaining residual thrust, and a cardanic ring associated with the axial bearing and serving to compensate for alignment errors, wherein said balancing device is constructed such that a residual thrust in the direction of the suction side of the pump exists in all operating states of the pump, and the cardanic ring is dimensioned such that the cardanic ring is elastically deformed by the residual thrust and has a spring constant such that, starting from a maximum gap width (s) when the pump is at rest, the axial gap closes under operating conditions to a minimum width at which contact between the opposed faces delimiting the axial gap is still avoided.

2. An arrangement according to claim 1, wherein the balancing device is formed by a double piston comprised of two piston parts, and the axial gap is located between the two piston parts.

3. An arrangement according to claim 1, wherein the balancing device comprises a balancing disk which forms an axial gap with a counterdisk on the pump casing.

4. An arrangement according to claim 1, wherein said axial bearing is a hydrodynamic axial bearing.

5. A balancing arrangement for absorbing axial thrust of a multistage centrifugal pump with a suction side and a pressure side, comprising:

a balancing device having a plurality of axial gaps and radial gaps delimited by opposed faces of the balancing device and in which a balancing stream is conducted through the gaps, an axial bearing for absorbing remaining residual thrust, and a cardanic ring associated with the axial bearing and serving to compensate for alignment errors, wherein said balancing device is constructed such that a residual thrust in the direction of the suction side of the pump exists in all operating states of the pump, and the cardanic ring is dimensioned such that the cardanic ring is elastically deformed by the residual thrust and has a spring constant such that, starting from a maximum gap width (s) when the pump is at rest, the axial gaps close under operating conditions to a minimum width at which contact between the opposed faces delimiting the axial gaps is still avoided.

6. An arrangement according to claim 5, wherein the balancing device is formed by a stepped piston, and each of the axial gaps is located between two steps of said stepped piston.

7. An arrangement according to claim 5, wherein said axial bearing is a hydrodynamic bearing.

* * * * *